US006133560A

United States Patent [19]

Zeng et al.

[11] Patent Number: 6,133,560

[45] Date of Patent: Oct. 17, 2000

[54] PATTERNED MICROWAVE OVEN SUSCEPTOR

[75] Inventors: Neilson Zeng, Toronto; Igor Kotlarenko, North York, both of Canada

[73] Assignee: Fort James Corporation, Deerfield, Ill.

[21] Appl. No.: 09/169,001

[22] Filed: Oct. 9, 1998

Related U.S. Application Data

[63] Continuation-in-part of application No. PCT/CA98/00099, Feb. 12, 1998.

[60] Provisional application No. 60/037,909, Feb. 12, 1997.

[51] Int. Cl.[7] ..... H05B 6/80

[52] U.S. Cl. ..... 219/730

[58] Field of Search ..... 219/730, 728, 219/729, 759; 426/107, 234, 243; 99/DIG. 14

[56] References Cited

U.S. PATENT DOCUMENTS

| | | |
|---|---|---|
| 4,230,924 | 10/1980 | Brastad et al. . |
| 4,676,857 | 6/1987 | Scharr et al. . |
| 4,814,568 | 3/1989 | Keefer . |
| 4,904,836 | 2/1990 | Turpin et al. . |
| 4,927,991 | 5/1990 | Wendt et al. . |
| 4,962,293 | 10/1990 | Lackey . |
| 4,990,735 | 2/1991 | Lorenson et al. . |
| 5,038,009 | 8/1991 | Babbitt . |
| 5,059,279 | 10/1991 | Wilson . |
| 5,260,537 | 11/1993 | Beckett . |
| 5,266,386 | 11/1993 | Beckett . |
| 5,340,436 | 8/1994 | Beckett . |
| 5,354,937 | 10/1994 | Ebel et al. . |
| 5,519,195 | 5/1996 | Keefer et al. . |
| 5,698,127 | 12/1997 | Lai et al. ..... 219/728 |

*Primary Examiner*—Teresa Walberg
*Assistant Examiner*—Jeffrey Pwu
*Attorney, Agent, or Firm*—Burns, Doane, Swecker & Mathis, L.L.P.

[57] ABSTRACT

A patterned susceptor structure has a relatively thin electro-conductive material for converting incident microwave energy to thermal energy. The patterned susceptor has a lobe shaped island strip nested within and surrounded by an outer strip. The island strip is coupled to the outer strip to stimulate uniform heating between an outer edge of the susceptor structure and a center portion of the susceptor structure. The island strip is coupled to the outer stip by spacing the island strip from the outer strip with a microwave-transparent slotline.

14 Claims, 10 Drawing Sheets

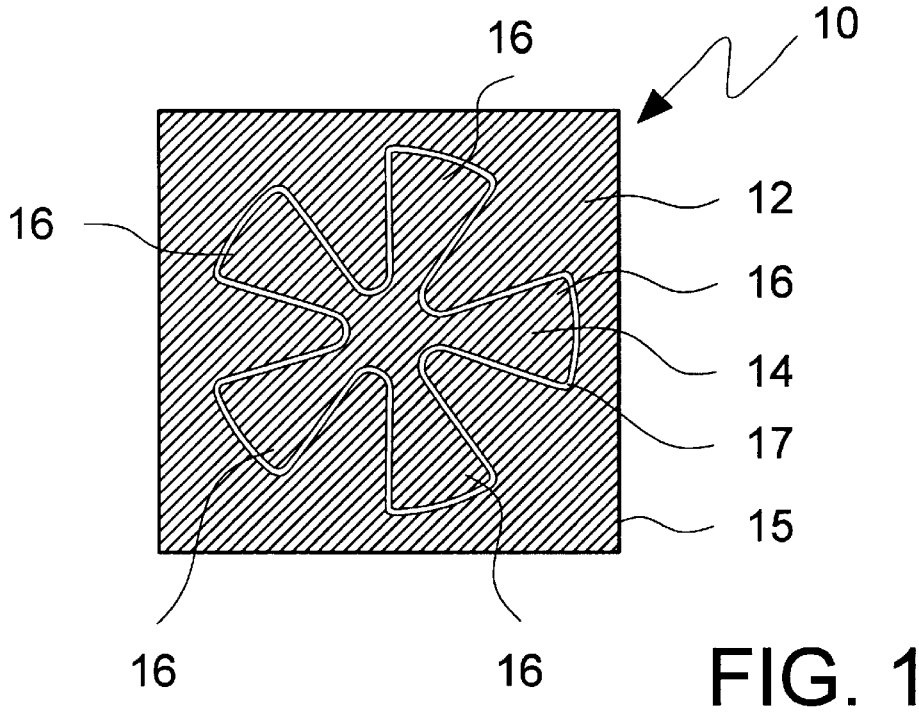
FIG. 1
FIG. 2
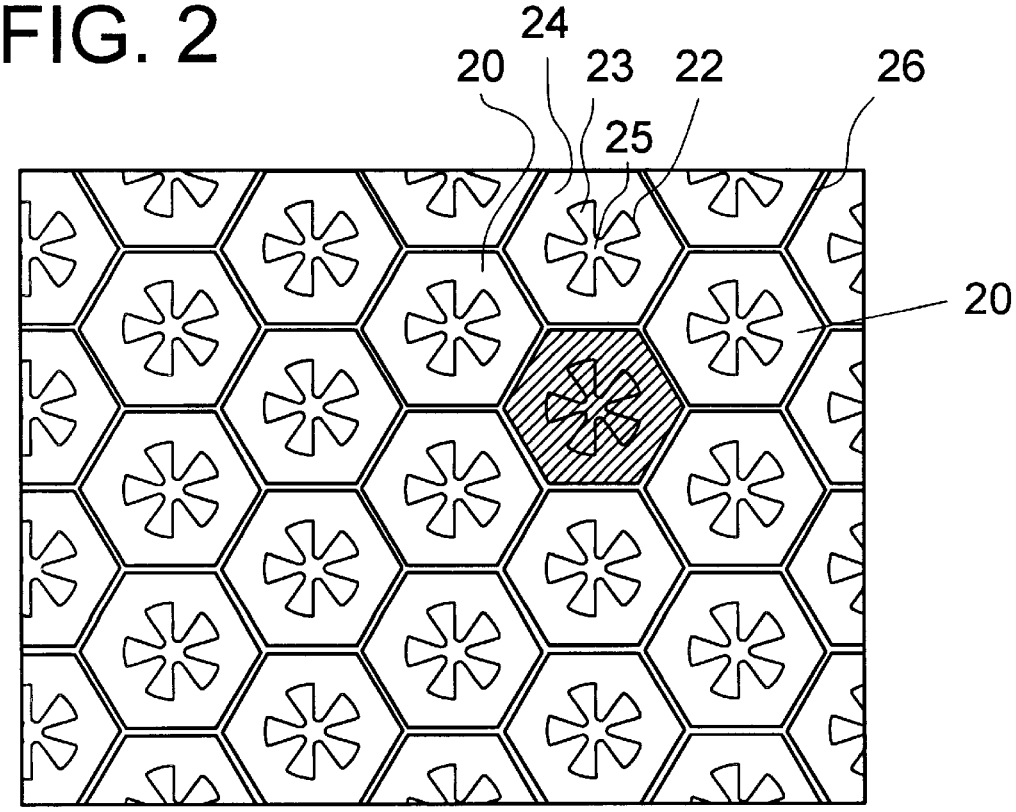

PATTERNED MICROWAVE OVEN SUSCEPTOR

This is a Continuation of International PCT application No. PCT/CA98/00099 filed on Feb. 12, 1998. Also claims the benefit of Provisional No. 60/037,909 filed Feb. 12, 1997.

FIELD OF INVENTION

This invention relates to a high efficiency patterned susceptor. In particular, this invention relates to a patterned susceptor which will redistribute power within a plain susceptor and decrease power reflection while maintaining high power absorption.

BACKGROUND OF THE INVENTION

A good deal of work has been done to create materials or utensils that permit foods to be cooked in a microwave oven to obtain the cooking characteristics of conventional ovens. The most popular device being used is the plain susceptor material. Plain susceptors are convenient in cooking applications and low in cost.

Susceptors have been widely used in microwave food cooking since the early 1980's. Susceptors can be quite effective in generating local surface heat and contributing significantly to crisping of food surfaces. However susceptors failed to meet the full microwave cooking potential due to three distinct problems.

First, susceptors have an inability to uniformly brown and crisp items in a similar way as conventional ovens. The edge region of a susceptor is generally much hotter compared to the center region of the susceptor. This effect is often caused by the E-field strength in the edge of the plain susceptor being stronger than the center region due to the loading effects of the adjacent foodstuffs.

Secondly, there is the inability to generate uniform temperature distributions within bulk products. This effect is due to the susceptor's inability to conduct power parallel to its surface or to provide good shielding.

Thirdly, the susceptor has an inability to generate consistent heating under varying microwave E-field strengths as well as different loading conditions of the food. Portions of a susceptor that are exposed to high electric field strengths and/or poor heat sinking tend to overheat. This overheating causes thermal damage to the substrate and hence damage to the metallized layer. The net result is that the susceptor becomes substantially transparent.

In general, susceptor material does not have any ability to control non-uniformity and to adapt to the variations of oven field strength and loading applications. In other words, susceptor material has only a limited ability to obtain uniform and reliable heating power within the microwave oven.

Other solutions have proposed the use of different patterned structures, such as square matrixes or "fused" structures, to avoid the over heating of the susceptor edge. Such square matrixes and other shaped structures are described in U.S. Pat. Nos. 5,260,537 and 5,354,973. However these patterned structures lead to significant reduction in the overall power absorption capability of the susceptor material. As a result, such susceptors can only function as a weak surface heating material.

SUMMARY OF THE INVENTION

The disadvantages of the prior art are overcome by providing a high efficiency patterned susceptor which will redistribute power within a plain susceptor and decrease power reflection while maintaining high power absorption.

It is desirable to provide a patterned susceptor which increases power transmittance towards the food load.

According to one aspect of the invention, there is provided a patterned susceptor comprising an island strip nested within and surrounded by an outer strip. The island strip is spaced from the outer strip by a microwave transparent slotline. The slotline has a length resonant at the frequency of a microwave oven. The island strip has a plurality of lobes. The outer strip has a regular polygon outline.

According to another aspect of the invention, there is provided a patterned susceptor comprising an island strip nested within and surrounded by an outer strip. The island strip is coupled to the outer strip to stimulate uniform heating between an outer edge of the susceptor and a center portion of the susceptor.

According to another aspect of the invention, there is provided a periodic array of patterned susceptor structures for converting incident microwave energy to thermal energy. Each patterned structure comprising an island strip nested within and surrounded by an outer strip. The island strip is coupled to the outer strip to stimulate uniform heating between an outer edge of the susceptor structure and a center portion of the susceptor structure.

According to yet another aspect of the invention, there is provided a periodic array of patterned susceptor structures comprising an island strip nested within and surrounded by an outer strip. The island strip is spaced from the outer strip by a metallic stripline.

DESCRIPTION OF THE DRAWINGS

In drawings which illustrate the preferred embodiments of the invention,

FIG. 1 is a plan view of a susceptor pattern of the present invention;

FIG. 2 is a plan view of a periodical array of the susceptor patterns of FIG. 1 interlocked together;

DESCRIPTION OF THE INVENTION

Figure 3:
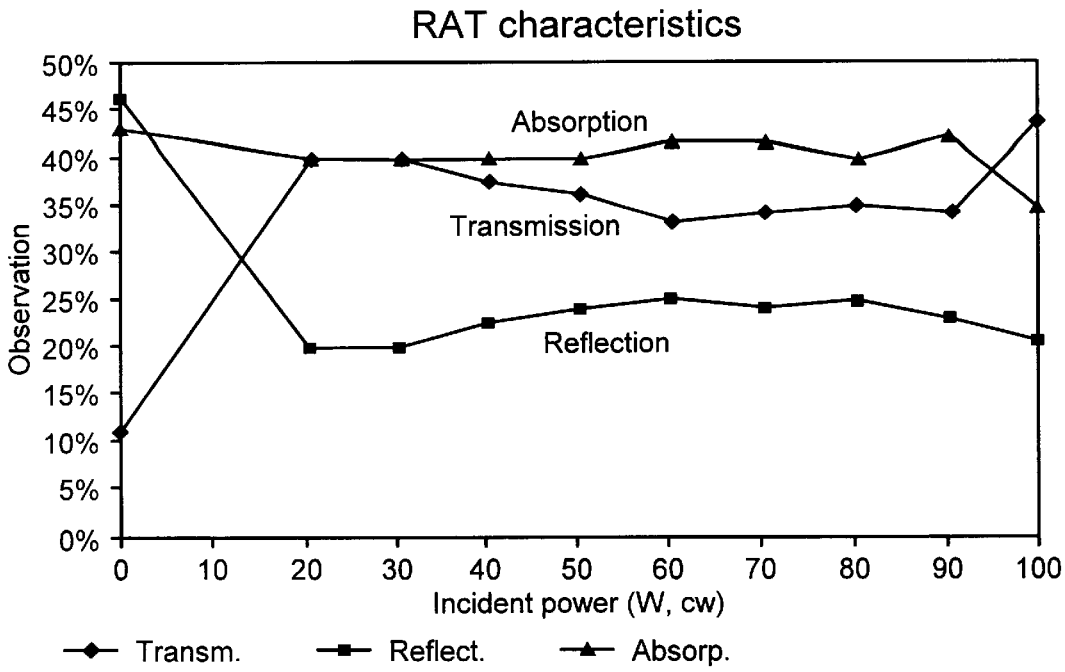
FIG. 3 is a graph of the performance characteristics of a plain susceptor.

The susceptor pattern 10 of the present invention is shown in FIG. 1. The susceptor pattern 10 has two separate pieces of even heating strips 12 and 14. Outer strip 12 has an outer perimeter 15. Lobe shaped strip 14 is an island nested within and surrounded by outer strip 12. A microwave transparent slotline 17 extends about the lobe-shaped island strip 14, spacing island strip 14 from outer strip 12. Each of the strips 12 and 14 will act as a uniform high efficiency heating unit and has improved functionality over a plain susceptor.

Strips 12 and 14 are made of electroconductive material, typically evaporated or sputtered, having a thickness thin enough to cause heating under the influence of a microwave field. Materials for use as susceptors are more fully described in U.S. Pat. Nos. 4,230,924 and 4,927,991. The susceptor material is bonded or applied to a microwave transparent substrate such as a polymeric film or paper or paperboard. Packaging material may be formed from the resulting laminate.

In the preferred embodiment, the susceptor pattern 10 is on a microwave transparent substrate, such as a polymeric material. Methods of applying a susceptor layer onto a suitable substrate are more fully described in U.S. Pat. Nos. 5,266,386 and 5,340,436, the contents of which are hereby incorporated herein by reference.

The power redistribution function of each strip 12 and 14 is governed by the quasi-resonant of the strips 12 and 14 through proper selection the shape and perimeter length thereof. Strip 12 has a plurality of lobe strips 16 which may be tuned to be resonant at the standard domestic microwave oven frequency. For instance, if the physical perimeter length of the slotline 17 is 120 mm, the $S_{11}$ characteristics (ie. forward reflection) shown in FIG. 15 indicates a resonant dip at 2.1 GHz under open load operation. In addition, multiples of the perimeter lengths will also display resonance effects. A further, design feature would take into account the dielectric effects of the adjacent food, i.e. the effective wavelength would be reduced when in contact with the food. For example, each strip 12, 14 of susceptor may be tuned to be resonant at the microwave oven frequency when the food load is placed on it and detuned from resonance in the absence of the food. This will be equalize the heating capability over a fairly large area where there is not full coverage or contract with other food.

In the preferred embodiment, the outer perimeter shape of each susceptor pattern 20 is hexagonal. A hexagonal shape provides an efficient nesting shape for complete coverage of the substrate on which the susceptor patterns 20 are applied. In addition, the hexagonal perimeter creates a pattern that displays a high degree of cylindrical symmetry. The individual cells the approximate omni-directional heating elements that are insensitive to the package orientation. Each susceptor pattern is separated and spaced from adjacent susceptor patterns by a microwave transparent slotline 26. Slotline 26 may also be scaled to be resonance at the microwave oven frequency.

The coupling between lobe-shaped island strips 22 inside the hexagonal outer strip 24 is designed to permit redistribution of power, i.e. moving the heating power from outer edge 23 of lobe-shaped island strip 22 toward its center portion 25. This is achieved due to the curvature nature of slotline 26. The field strength distribution with the slotline is focused towards the center region due to higher localized capacitance.

When the food is contacted in vicinity to strips 22 and 24, the quasi-resonant characteristic of the strips 22 and 24 can stimulate stronger and uniformity cooking. As distinct from a full sheet plain susceptor, the patterned susceptor 20 can stimulate uniform heating between the edge and center portion of the sheet and achieve a more uniform heating effect than the plain susceptor. The average width and perimeter of the slotline 26 will determine effective strength of the slotline 26 in the heating. An example of an effective slotline 26 has a perimeter length of 120 mm and a width of 1 mm. Many other dimensioned combinations would also be effective.

Figure 4:
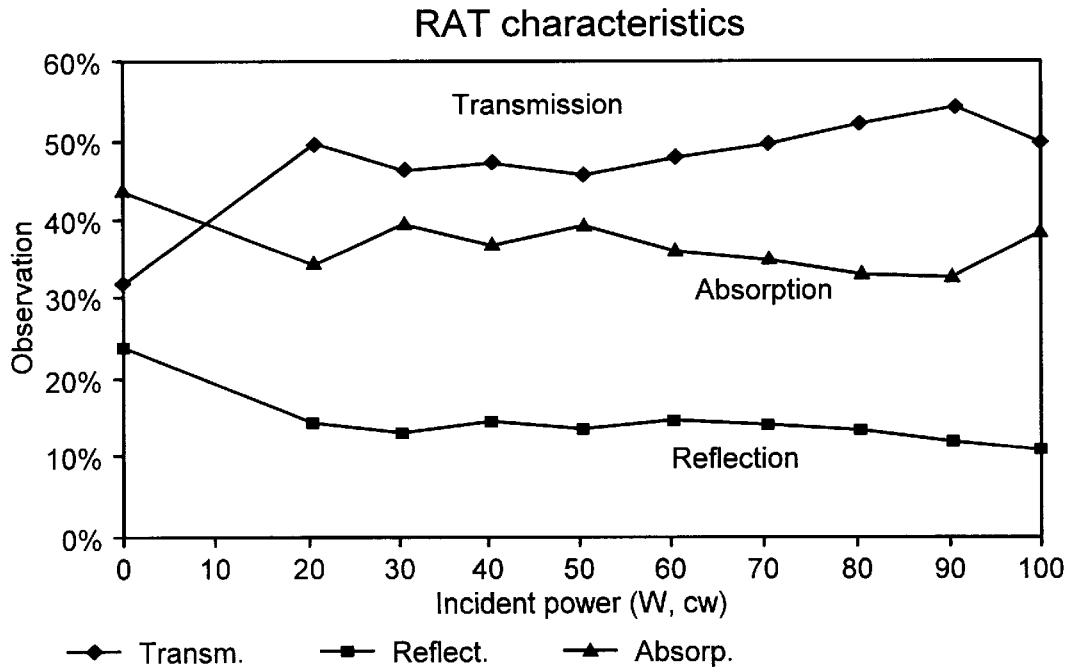
FIG. 4 is a graph of the performance characteristics of a patterned susceptor of the FIG. 2.

FIG. 3 demonstrates the Power Reflection-Absorption-Transmission (RAT) characteristics of plain susceptor and FIG. 4 demonstrates the RAT characteristics of a patterned susceptor of the present invention. Both were measured in NWA (low power radiation measurement) and in a High Power Test set of wave guide type WR430 under open load operation. FIG. 4 shows that the hexagonal strip patterned susceptor of FIG. 2 exhibited a similar power absorption function as the plain susceptor under 100 watt of open load measurement as illustrated in FIG. 3. Both samples had the same initial optical density. However, the power reflection for plain susceptor reaches 46% at low power radiation and 21% at high power radiation. While power reflection of patterned susceptor of the present invention only gives 24% at low power radiation and 11% at high power radiation. The two samples demonstrated the same power absorption at both low and high power variation. Note that any redistribution of the power absorption within the patterns cannot be distinguished with these measurements. It should also be noted that the plain susceptor as tested in FIG. 2, was considerably more cracked and damaged after the 100 watt test than the patterned susceptor.

Figure 5:
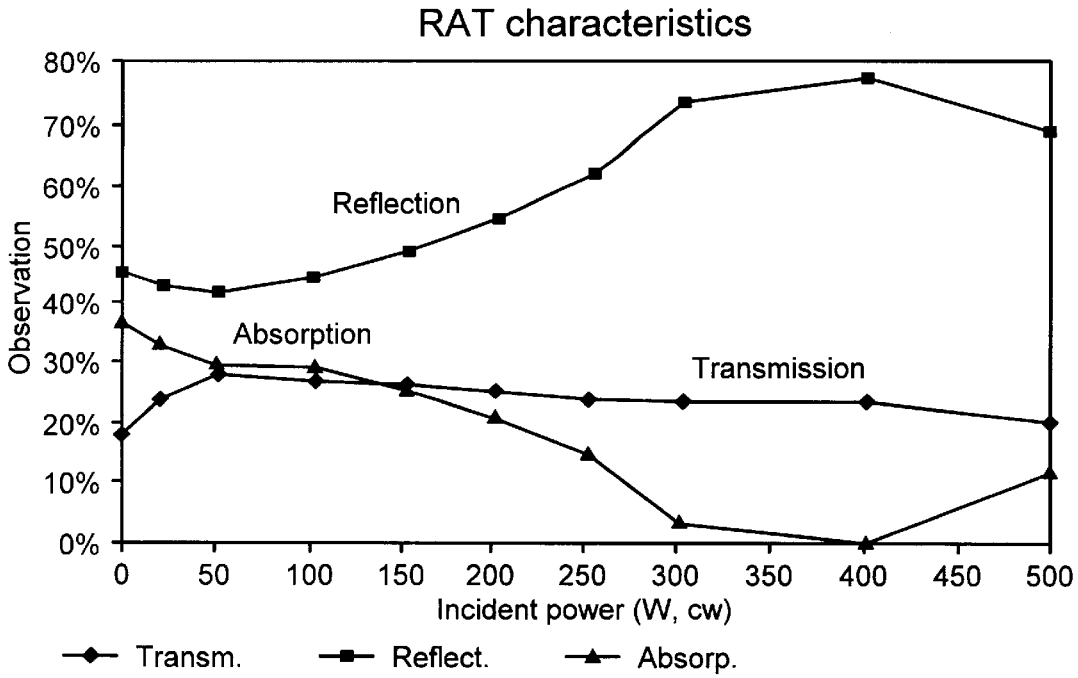
FIG. 5 is a graph of the performance characteristics of a plane susceptor contacting frozen pastry.
Figure 6:
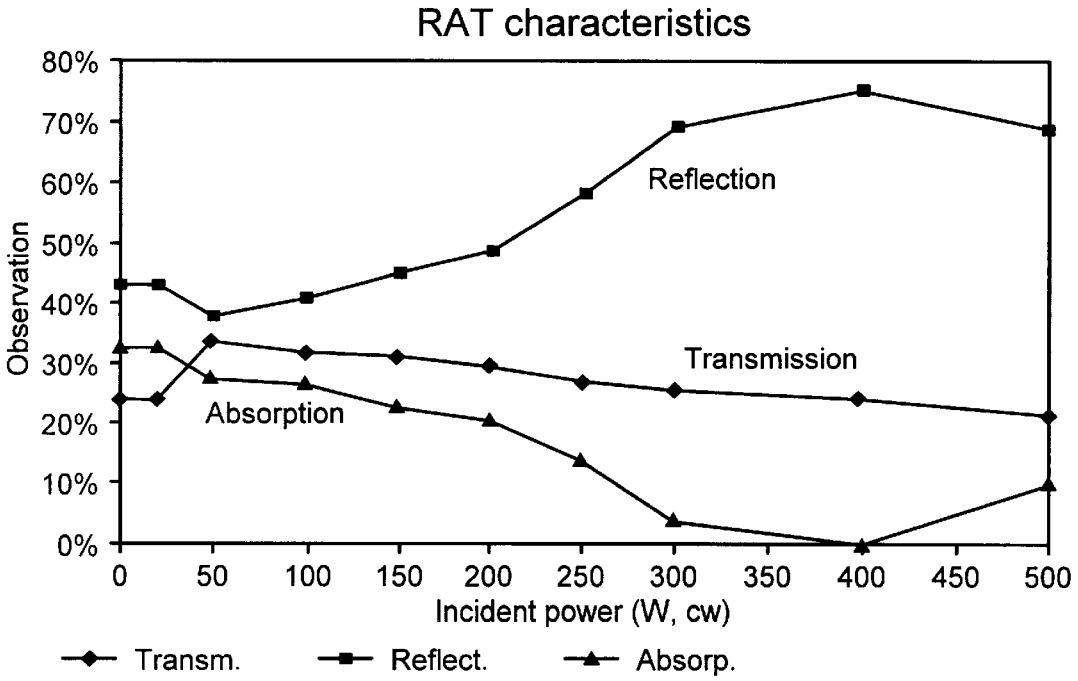
FIG. 6 is a graph of the performance characteristics of a patterned susceptor of the FIG. 2 contacting frozen pastry.
Figure 7:
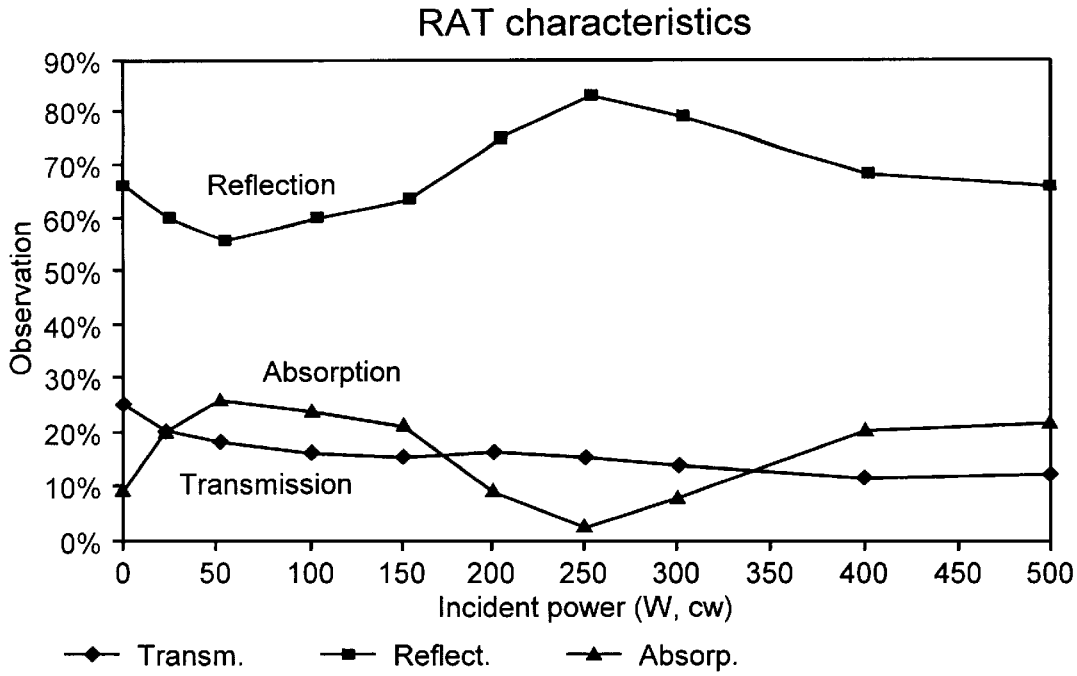
FIG. 7 is a graph of the performance characteristics of a plane susceptor contacting defrosted pastry.
Figure 8:
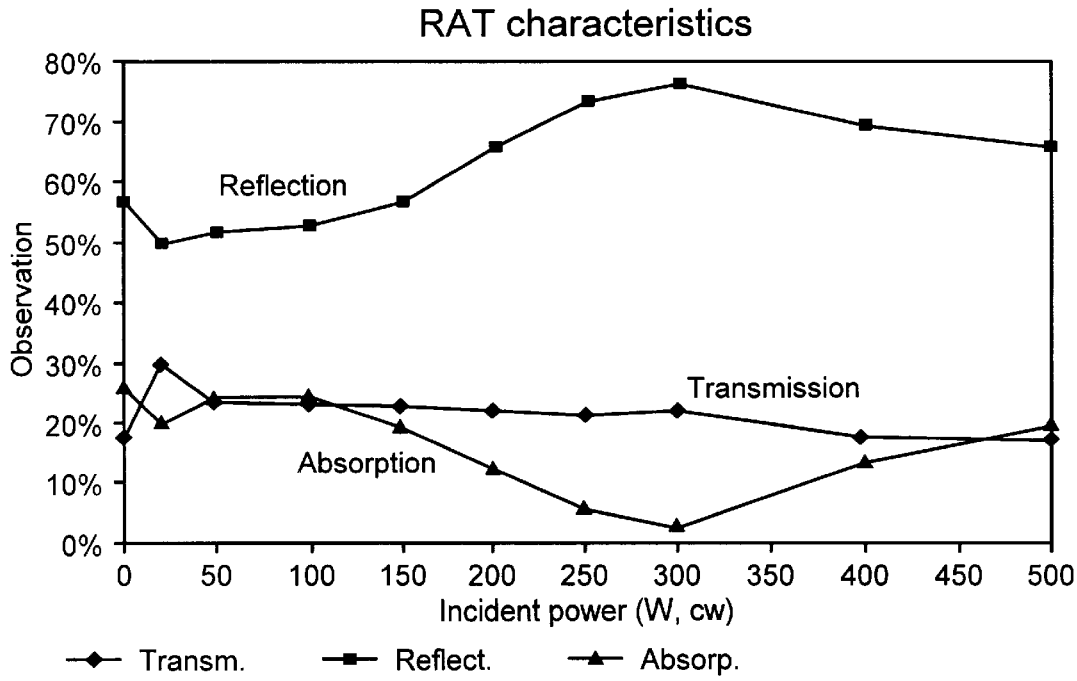
FIG. 8 is a graph of the performance characteristics of a patterned susceptor of the FIG. 2 contacting defrosted pastry.

FIGS. 5 and 7 show the RAT performance of the same measurement when the plain susceptor is contacted with frozen and defrosted pastry, respectively. In comparison, FIGS. 6 and 8 shows the RAT performance of the same measurement when a hexagonal patterned susceptor of the present invention is contacted with a frozen and defrosted pastry, respectively.

The quasi-resonance effect occurs when the food is in contact with the hexagonal susceptor strip. As illustrated, the transmittance of the patterned susceptor appears to be 5 to 10% higher than that of the plain susceptor under loading a layer of pastry over the surface of heating materials while the power absorption of both susceptors remains the same level.

Figure 9:
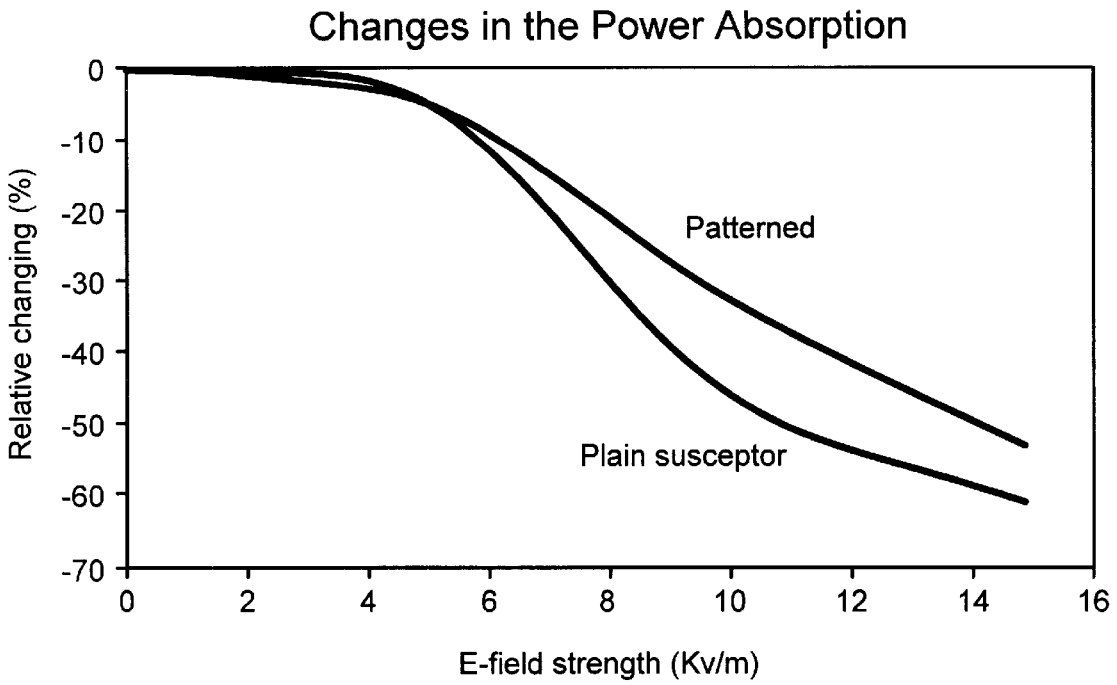
FIG. 9 is a graph illustrating the stability of power absorption of a plane susceptor and a patterned susceptor of FIG. 2 under changing E-field strength and open load operation.

FIG. 9 shows the stability of power absorption of both susceptors under changing E-field strength and open load operation. RAT characteristic data of each materials was measured after 10 minutes of continuous radiation at each level of E-field strength. Test result showed that the patterned susceptor material of the present invention will be more durable than the plain susceptor due to the self adjustment of the power distribution capability.

Figure 10:
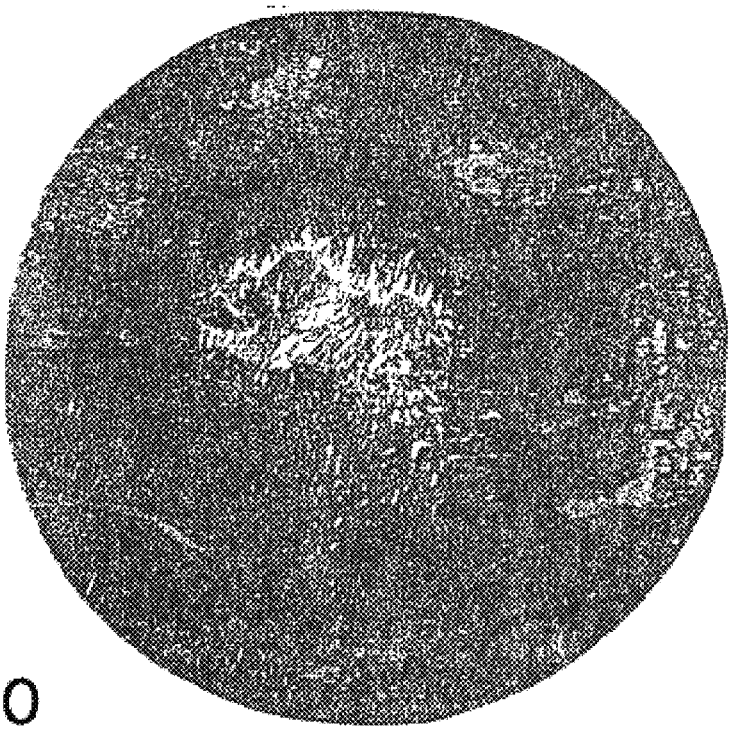
FIG. 10 is a thermal image of a plain susceptors exposed in microwave oven for 20 seconds under a layer of glass load operation.
Figure 11:
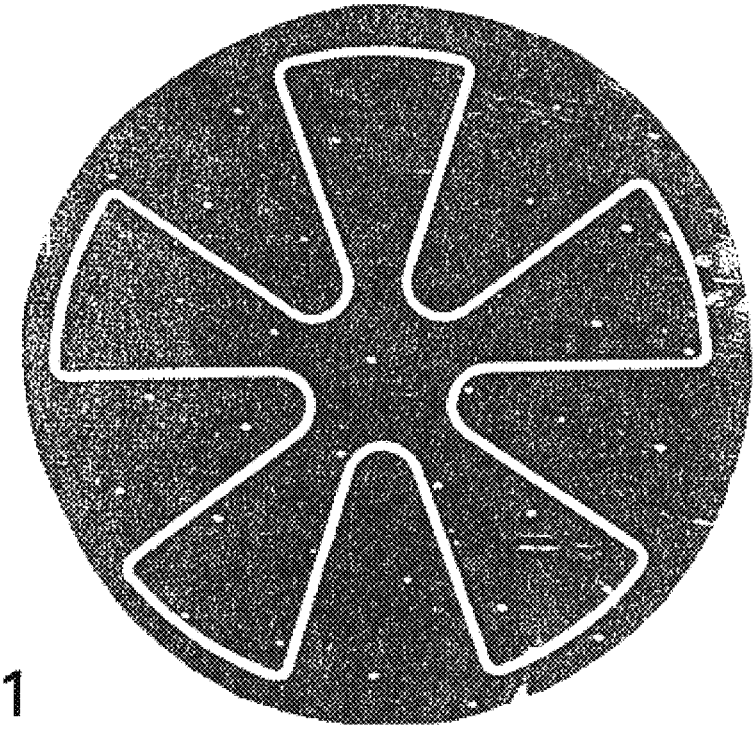
FIG. 11 is a thermal image of a patterned susceptor of FIG. 1 exposed in microwave oven were for 20 seconds under a layer of glass load operation.
Figure 12:
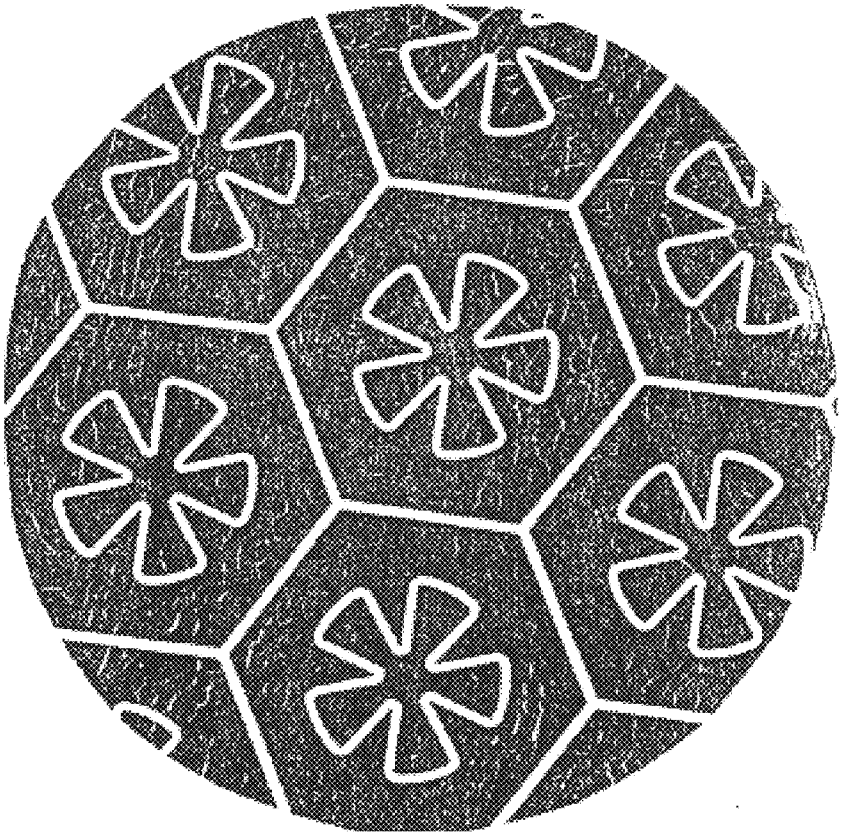
FIG. 12 is a thermal image of a patterned susceptor of FIG. 2 exposed in microwave oven were for 20 seconds under a layer of glass load operation.

FIGS. 10, 11 and 12 are thermal images of a plain susceptor, a patterned susceptor as illustrated in FIG. 1 and a patterned susceptor, as illustrated in FIG. 1, exposed in a microwave oven for 20 seconds under a layer of glass load operation. FIG. 10 shows a significant non-uniform heating spots in the plain susceptor. In contrast, FIGS. 11 and 12 exhibit relatively uniform heating images with enhanced heating effect along the slotline in the patterned susceptors of the present invention. In addition, the crazing of the PET carrier is less severe for the patterned susceptor of the present invention than it is for the plain susceptor.

Figure 13:
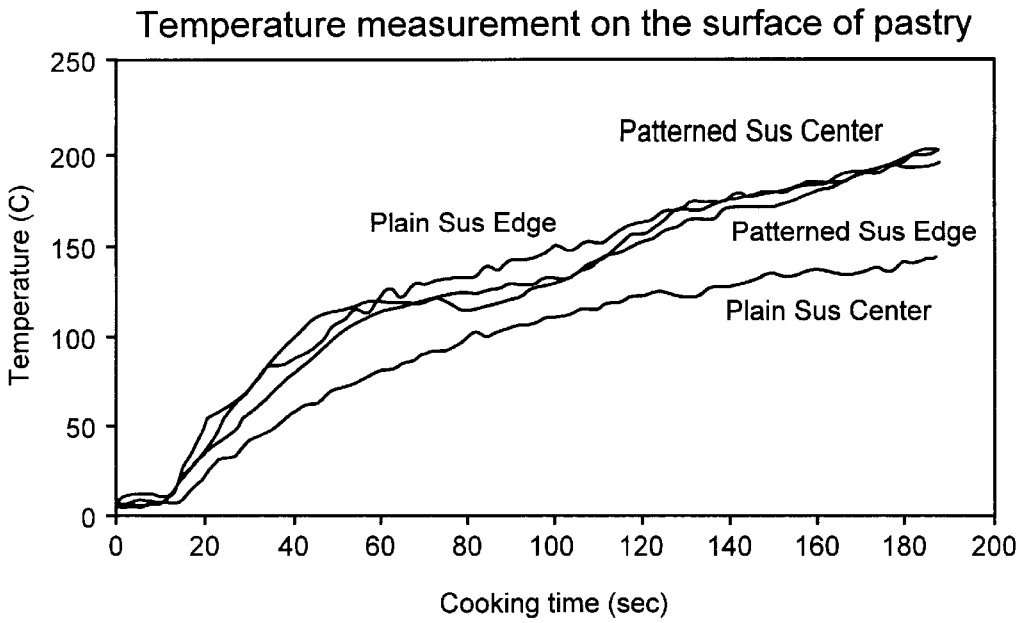
FIG. 13 is a graph showing a cooking response of a lid with a patterned susceptor of FIG. 2 for cooking in a microwave oven of a 28 oz frozen fruit pie.
Figure 14:
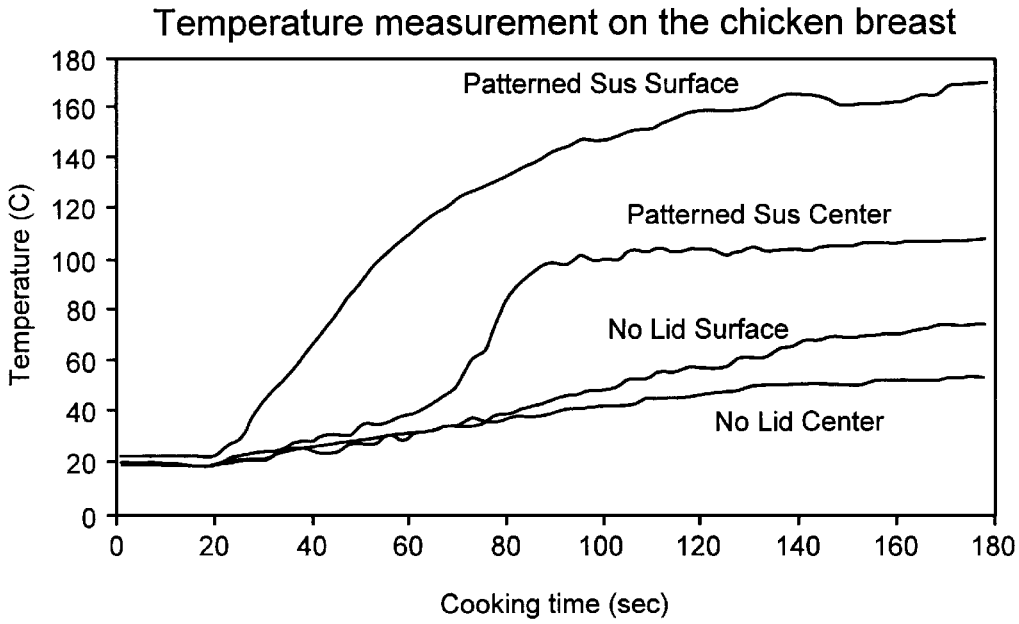
FIG. 14 a cooking response of a lid with a patterned susceptor of the present invention for cooking in a microwave oven of a chicken breast.

Temperature profiles of the pastry under heating with plain and patterned susceptors are shown in FIGS. 13 and 14 on sample foods. Four fluoroptic temperature probes were used to generate the charts.

A practical example of the effectiveness of the high efficiency patterned susceptor of the present invention can be seen with a Beckett Micro-Rite™ product developed for the microwave baking of frozen pot pie, fruit pie as well as for the microwave roasting of the defrosted chicken breast, leg and pork chop meat (B.B.Q meat or Cha Shao in Chinese dishes) accommodated with very low cost.

FIG. 13 shows a cooking response of a lid with a patterned susceptor of the present invention for cooking in a microwave oven of a 28 oz frozen fruit pie. It takes approximately 14 to 15 minutes in a 800 to 900 watt output power oven. The lid of the cooking package is provided with a patterned susceptor sheet with periodical array of the basic structure shown in FIG. 2. In this configuration the heating effect of the center portion is as strong as the edge of the hexagonal strip. Cooking result showed this lid can generate an even baking over the top surface. The lid can-be exposed at the E-field strength to as high as 15 kV/m without any risk of charring in the packaging box.

FIG. 14 illustrates the temperature profile from the microwave roasting of a piece of fresh chicken breast (100 g weight). The lid having a patterned susceptor of the present invention is set on top of the chicken breast and covered with a porcelain bowl. It takes approximately 3 to 4 minutes for a 800 to 900 watt oven.

The cooking result of the chicken breast exhibited a nice crisping and browning of the breast surface while the heating temperature of the inner meat met the health safety requirement of the food.

The high efficiency patterned susceptor of the present invention can be used in several formats such as baking lid, trays and discs with or without lamination of an additional foiled pattern. In general, the patterned susceptor of the present invention is able to generate greater transmittance of radiation power than a plain susceptor at the same level of power absorption along with enhanced uniformity.

Figure 15:
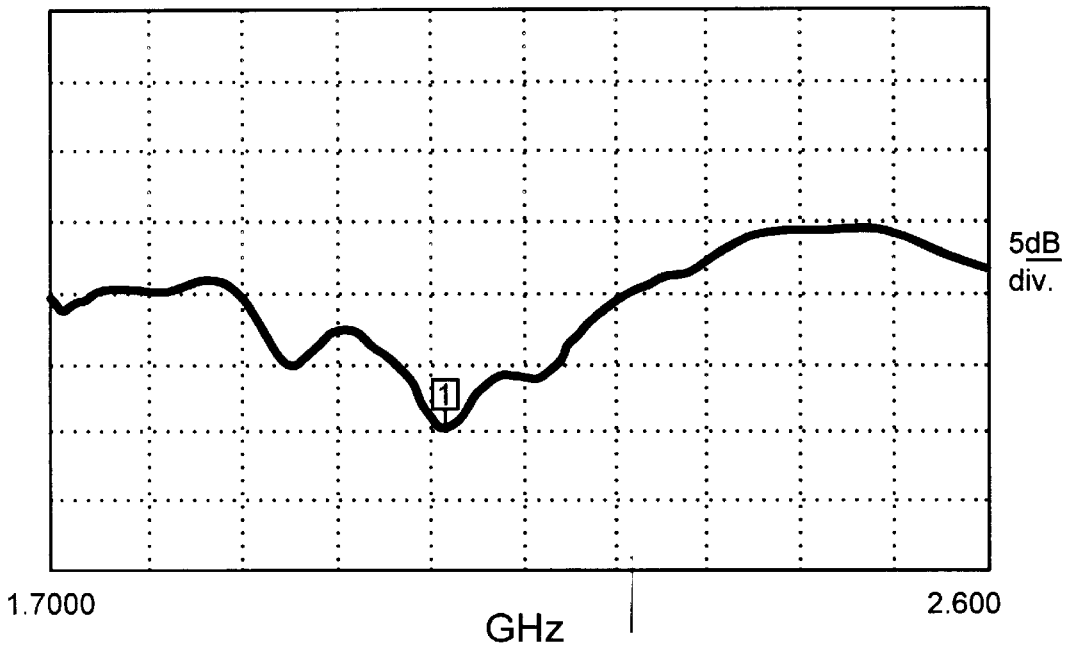
FIG. 15 is a graph showing the $S_{11}$ characteristics of a single element from the sample patterned susceptor in FIG. 2.
Figure 16:
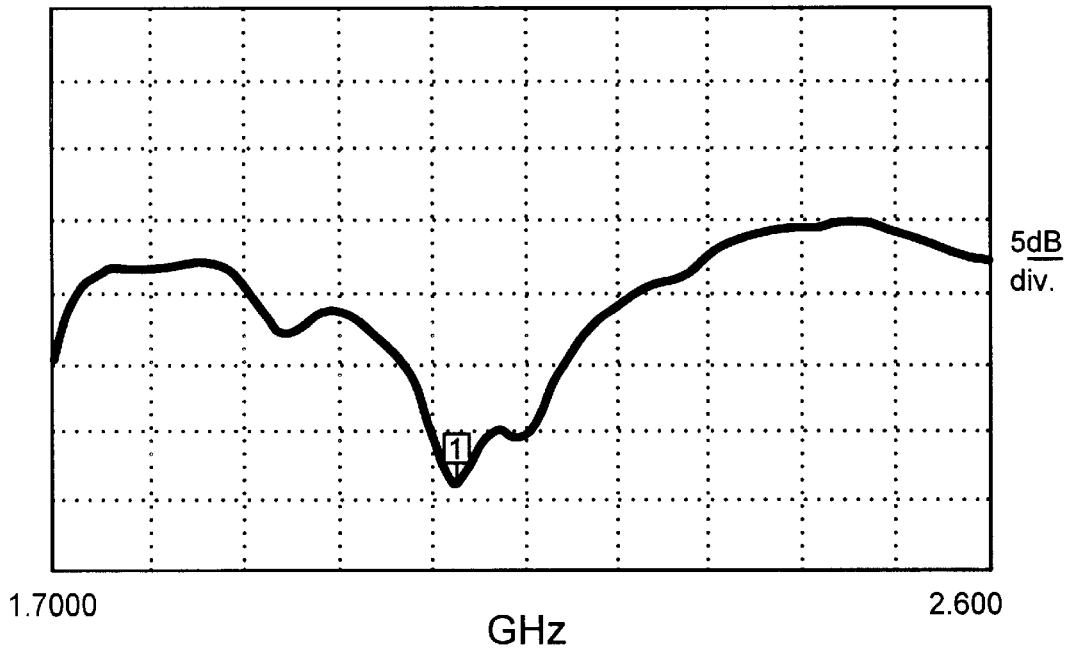
FIG. 16 is a graph showing the $S_{11}$ characteristics of the island lobed strip of patterned susceptor of FIG. 15.
Figure 17:
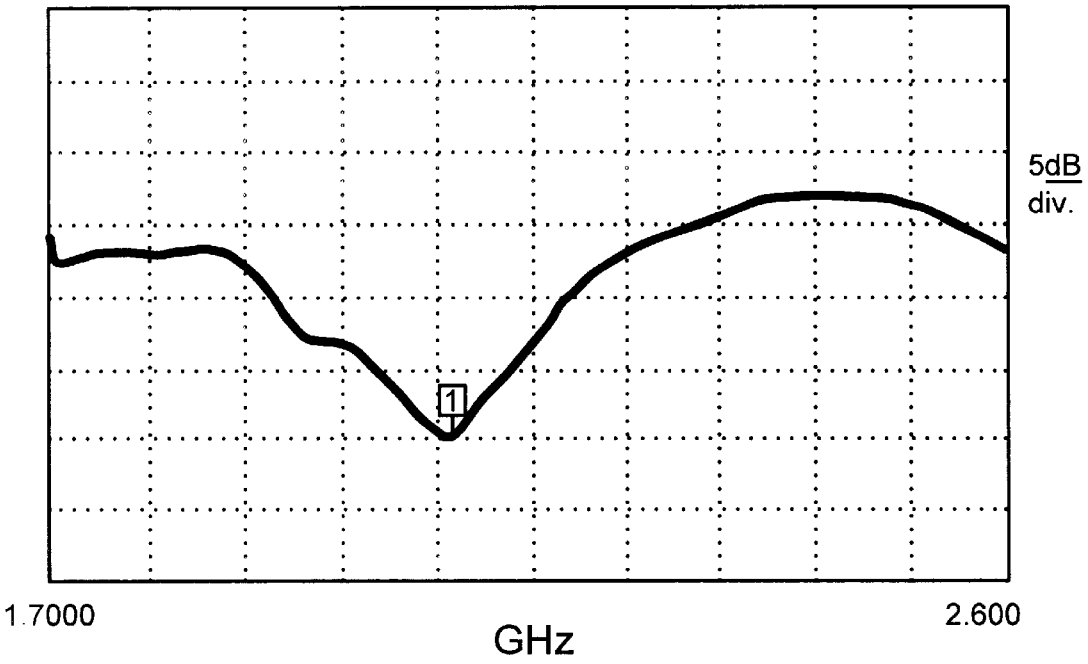
FIG. 17 is a graph showing the $S_{11}$ characteristics of the outer strip of patterned susceptor of FIG. 15.

Referring to FIGS. 15, 16 and 17, the $S_{11}$ characteristics of the patterned susceptor, the island lobed susceptor strip and the outer susceptor strip, respectively, are graphically illustrated. All three graphs demonstrate the resonant effect.

A further improvement in the present invention could also be realized by substituting the microwave transparent areas that form the slotlines 17, 22 and 26 with metallic striplines. For example, heavy evaporating sputtered material, or foil metals may be utilized to apply the striplines. Metallic striplines would display the same resonant effects but the Q-factors would be higher. The power redistribution and enhanced transmission effects would therefore be stronger.

Figure 18:
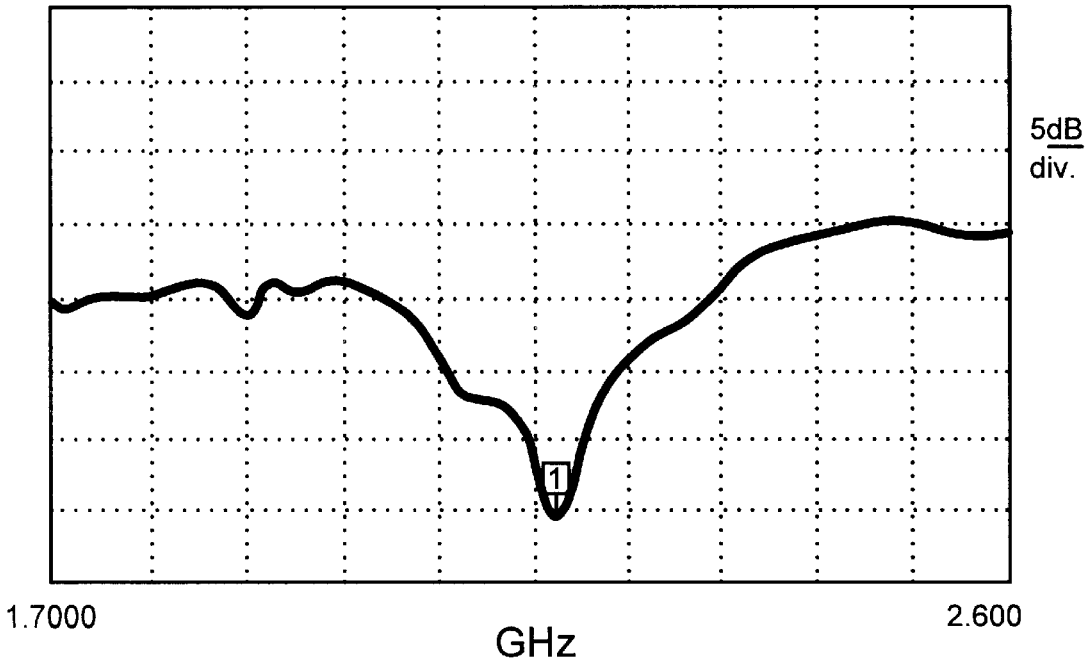
FIG. 18 is a graph showing the $S_{11}$ characteristics of a patterned susceptor of FIG. 2 wherein the slotlines are replaced with metallic striplines.

Referring to FIG. 18, the $S_{11}$ characteristics of the patterned susceptor when the slotlines 17, 22 and 26 are replaced by metallic striplines. The Q resonance is clearly higher than the transparent slotline case as predicted:

It is now apparent to a person skilled in the art that numerous combinations and variations of patterned susceptors of the present invention may be manufactured. However, since many other modifications and purposes of this invention become readily apparent to those skilled in the art upon perusal of the foregoing description, it is to be understood that certain changes in style, amounts and components may be effective without a departure from the spirit of the invention and within the scope of the appended claims.

We claim:

1. A patterned susceptor for converting incident microwave energy to thermal energy, comprising:

a substrate; and an island strip enclosed within an outer strip, the island strip and the outer strip formed of a electroconductive material and having a thickness thin enough to become heated under the influence of microwave energy, the island strip and the outer strip mounted on the microwave-transparent substrate, the island strip spaced from the outer strip defining a microwave-transparent slotline therebetween, the slotline having a perimeter length resonant with an operating frequency of a microwave oven.

2. The patterned susceptor as claimed in claim 1, wherein the outer strip has a regular polygon outline.

3. The patterned susceptor as claimed in claim 1, wherein the outer strip has a square outline.

4. The patterned susceptor as claimed in claim 1, wherein the outer strip has a hexagonal outline.

5. The patterned susceptor as claimed in claim 1, wherein the island strip has a plurality of lobes.

6. The patterned susceptor as claimed in claim 5, wherein the outer strip has a regular polygon outline.

7. The patterned susceptor as claimed in claim 5, wherein the outer strip has a square outline.

8. The patterned susceptor as claimed in claim 5, wherein the outer strip has a hexagonal outline.

9. A patterned susceptor of relatively thin electroconductive material for converting incident microwave energy to thermal energy, comprising an island strip enclosed within an outer strip, the island strip coupled to the outer strip by a spacing of the outer strip from the island strip on a microwave-transparent material, the spacing permitting a redistribution of power between the island strip and the outer strip:

wherein the coupled island strip and outer strip stimulate uniform heating between an outer edge of the susceptor and a center portion of the susceptor.

10. A periodic array of patterned susceptor structures of relatively thin electroconductive material for converting incident microwave energy to thermal energy, each patterned susceptor structure comprising an island strip enclosed within an outer strip, the island strip being spaced from the outer strip on a microwave-transparent material, the island strip coupled to the outer strip to stimulate uniform heating between an outer edge of the susceptor structure and a center portion of the susceptor structure, and each patterned susceptor structure nested with adjacent patterned susceptor structures so that the outer strip of each patterned susceptor is coupled to adjacent outer strips of adjacent patterned susceptor structures and each patterned susceptor structure is spaced from adjacent patterned susceptor structures by a microwave-transparent material.

11. The periodic array of patterned susceptors as claimed in claim 10, wherein each of the outer strips has a hexagonal outline.

12. The periodic array of patterned susceptors as claimed in claim 11, wherein each of the island strips has a plurality of lobes.

13. The periodic array of patterned susceptors as claimed in claim 12, wherein each of the lobes is regularly shaped and has a perimeter length near resonant with an operating frequency of a microwave oven.

14. A patterned susceptor for converting incident microwave energy to thermal energy, comprising:

an island strip enclosed within an outer strip, the island strip and the outer strip formed of an electroconductive material and having a thickness thin enough to become heated under the influence of microwave energy, the island strip spaced from the outer strip by a metallic stripline, the stripline having a perimeter length resonant with an operating frequency of a microwave oven.

* * * * *